US008245336B2

(12) United States Patent
Marugg

(10) Patent No.: US 8,245,336 B2
(45) Date of Patent: Aug. 21, 2012

(54) OPERATING TABLE

(75) Inventor: Silvio Marugg, Stetten (CH)

(73) Assignee: Berchtold Holding GmbH, Tuttlingen (DE)

( * ) Notice: Subject to any disclaimer, the term of this patent is extended or adjusted under 35 U.S.C. 154(b) by 2 days.

(21) Appl. No.: 12/754,783

(22) Filed: Apr. 6, 2010

(65) Prior Publication Data

US 2010/0263124 A1 Oct. 21, 2010

(30) Foreign Application Priority Data

Apr. 21, 2009 (DE) ..... 10 2009 018 270

(51) Int. Cl.
*A47B 7/00* (2006.01)

(52) U.S. Cl. ..... 5/608; 5/607

(58) Field of Classification Search ..... 5/600, 608, 5/601; 269/325; 378/209
See application file for complete search history.

(56) References Cited

U.S. PATENT DOCUMENTS

| | | | | |
|---|---|---|---|---|
| 765,389 | A | 7/1904 | Lawrence | |
| 1,814,482 | A | 7/1931 | Miller | |
| 3,227,439 | A | 1/1966 | Carlson | |
| 4,101,120 | A | 7/1978 | Seshima | |
| 4,572,493 | A * | 2/1986 | Hubert | 5/608 |
| 5,297,539 | A | 3/1994 | Liebl et al. | |
| 5,410,767 | A * | 5/1995 | Barud | 5/601 |
| 5,621,933 | A * | 4/1997 | Knapp et al. | 5/608 |
| 6,416,219 | B1 | 7/2002 | Pflaum et al. | |
| 6,640,363 | B1 * | 11/2003 | Pattee et al. | 5/601 |
| 6,935,780 | B2 | 8/2005 | Barde et al. | |
| 7,373,676 | B2 * | 5/2008 | Markovic et al. | 5/601 |
| 7,694,366 | B2 | 4/2010 | Koch et al. | |
| 7,784,126 | B2 * | 8/2010 | Meissner et al. | 5/600 |

FOREIGN PATENT DOCUMENTS

| | | | |
|---|---|---|---|
| DE | 19920008 | A1 | 12/2000 |
| DE | 10029429 | A1 | 1/2002 |
| DE | 102005053753 | A1 | 5/2007 |
| DE | 102005054222 | A1 | 5/2007 |

OTHER PUBLICATIONS

German Search Report dated Mar. 25, 2010 in corresponding German Patent Application No. 10 2009 018 270.5, 4 pages.
English translation of German Search Report dated Mar. 25, 2010 in corresponding German Patent Application No. 10 2009 018 270.5, 5 pages.
European Search Report in corresponding European Patent Application 2243456 dated Apr. 27, 2011, 3 pages.
English language translation of European Search Report in corresponding Europe Patent Application 2243456 dated Apr. 27, 2011, 3 pages.

* cited by examiner

*Primary Examiner* — Robert G Santos
*Assistant Examiner* — Brittany Wilson
(74) *Attorney, Agent, or Firm* — Lewis and Roca LLP

(57) ABSTRACT

An operating table has a column on which a table top is supported so that it is pivotable about an axis extending transversely to the table top and about an axis extending longitudinally to the table top, with the table top being connected to the column via joint parts which are rotatable.

15 Claims, 3 Drawing Sheets

OPERATING TABLE

CROSS-REFERENCE TO RELATED APPLICATIONS

This application claims priority to German Patent Application Number 10 2009 018 270.5, filed Apr. 21, 2009, the entirety of which is incorporated by reference herein.

BACKGROUND

The present invention relates to an operating table having a column on which a table top is supported such that it is pivotable about an axis extending transversely to the table top and about an axis extending longitudinally to the table top. In such operating tables which are known from the prior art, the lying surface can as standard be adjusted by ±30° in the transverse axis (also called trend or inclination) and by ±20° in the longitudinal axis (also called tilt or cant). A comprehensive combination of both movements is not always given due to construction constraints.

It is known in the operating tables known from the prior art to provide a gimbaled support of the table top in which the lying surface is pivoted about two mutually perpendicular axes of rotation with the aid of two lifting cylinders. Since the two axes of rotation are arranged at least approximately centrally to the column, the table top cannot be pivoted to a required degree, i.e. with the desired large tilt angles and trend angles.

It is the object of the present invention to further develop an operating table of the initially named kind such that large trend angles and tilt angles can be achieved with simple and inexpensive construction means.

This object is satisfied by the features of claim 1 and in particular in that the table top is connected to the column via a joint comprising two joint parts, with the joint being rotatable about a vertical axis of rotation. By the possibility of rotating the joint about a vertical axis of rotation, the joint can be rotated so that a pivot axis of the joint is positioned either at the one side or at the other side of the table top or in the direction of the head end or of the foot end of the table top. Very large trend angles and tilt angles can be achieved in this manner since the table top is no longer pivoted about a pivot axis which is substantially arranged centrally. The pivot axis can rather be rotated about the vertical axis of rotation so that the pivot axis is arranged on that side of the table top in whose direction pivoting should take place. In other words, the pivot axis of the joint can be brought to that position at which the inclination or canting is desired.

Extremely large pivot angles of up to 90° are possible with the solution in accordance with the invention. It is simultaneously possible to pivot the table top relative to the column if this is desired.

Advantageous embodiments of the invention are described in the description, in the drawing and in the dependent claims.

In a first advantageous embodiment, the joint itself can have precisely one pivot axis which can in particular be horizontally orientated. In this manner, the table top can be tilted in any desired direction without using a gimbal joint, with the pivot axis of the joint being able to be brought to the desired point at which the maximum inclination or canting is desired by pivoting about the vertical axis of rotation.

In accordance with a further advantageous embodiment, the table top can be connected to the column via a single joint, with the relative position between the table top and the joint and/or the relative position between the column and the joint being changeable. In this manner, the joint can, for example, be rotated between the table top and the column without the position of the table top relative to the column being changed.

In accordance with a further advantageous embodiment, the pivot axis of the joint can be arranged eccentrically to the center axis of the column and/or eccentrically to the center of the table top. In this manner, extremely large trend angles and tilt angles are possible since the pivot axis of the joint can be rotated to the position at which the inclination or canting is desired.

In accordance with a further advantageous embodiment, only a single lifting cylinder is provided to change the inclination of the table top. Any desired inclination of the table top can hereby be achieved by a single drive element acting in a translatory manner. A lifting cylinder which is connected to the table top via a ball joint can furthermore be provided for the adjustment of the inclination of the table top. This represents a simple and thus inexpensive construction realization.

It can furthermore be advantageous if two, and in particular precisely two, drives are provided for a pivoting of the table top which can preferably be driven in a synchronized manner by a controller. The two drives can in this manner be operated or driven so that the table top can be tilted or pivoted in any desired directions without itself carrying out any unwanted movements.

A simple and inexpensive construction variant results when overall only precisely one lifting cylinder and two rotary drives are provided as the drive for pivoting the table top.

In accordance with an advantageous embodiment, the joint is designed as a pivot plate whose two joint parts are mutually pivotable about a horizontal axis. Such a pivot plate provides good stability and can be made so that both joint parts each have an opening, with a lifting cylinder being led through the openings of the two joint parts. The desired variable pivotability can hereby be realized with a compact construction. To increase the stability, it can be advantageous if the two joint parts are made as a ring.

It can finally be advantageous if the joint is rotatable by 360° about the vertical axis of rotation since a maximum flexibility is given in this case.

The present invention will be described in the following purely by way of example with reference to an advantageous embodiment and to the enclosed drawings. There are shown:

DETAILED DESCRIPTION

Figure 1:
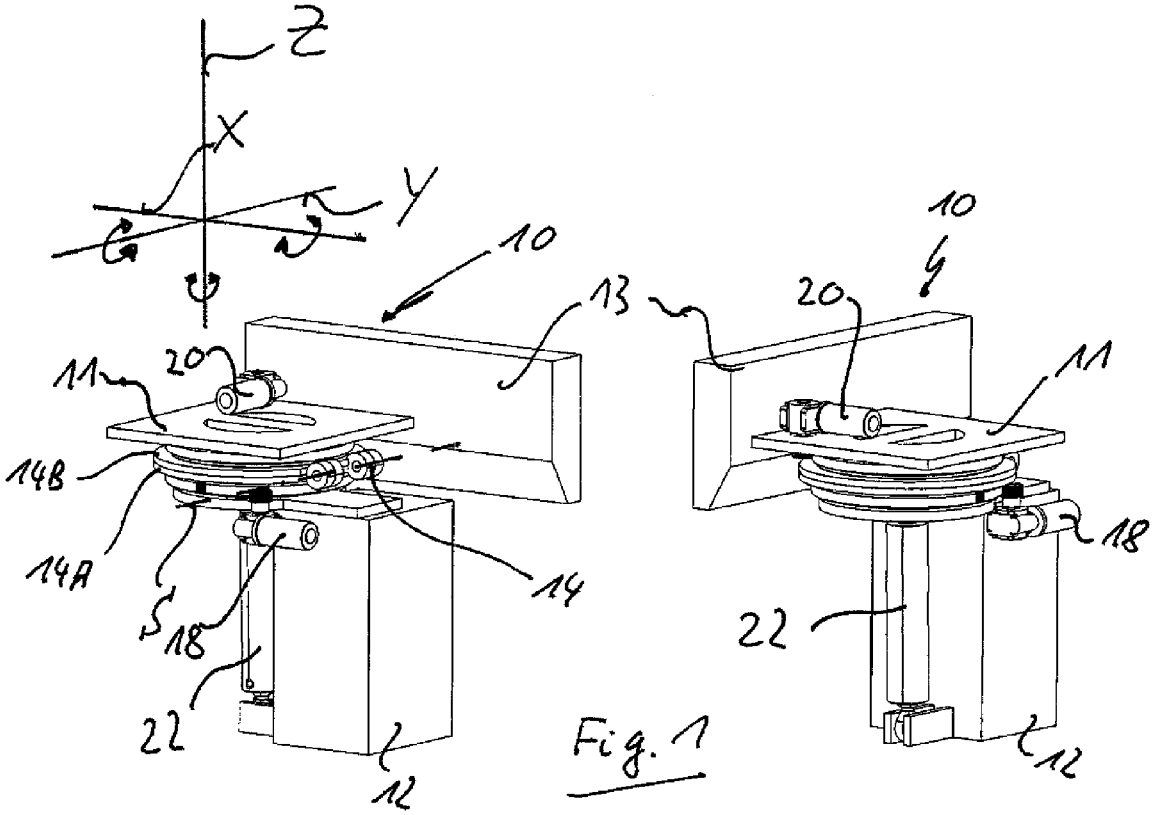
FIG. 1 a part of an operating table in its zero position.
Figure 5:
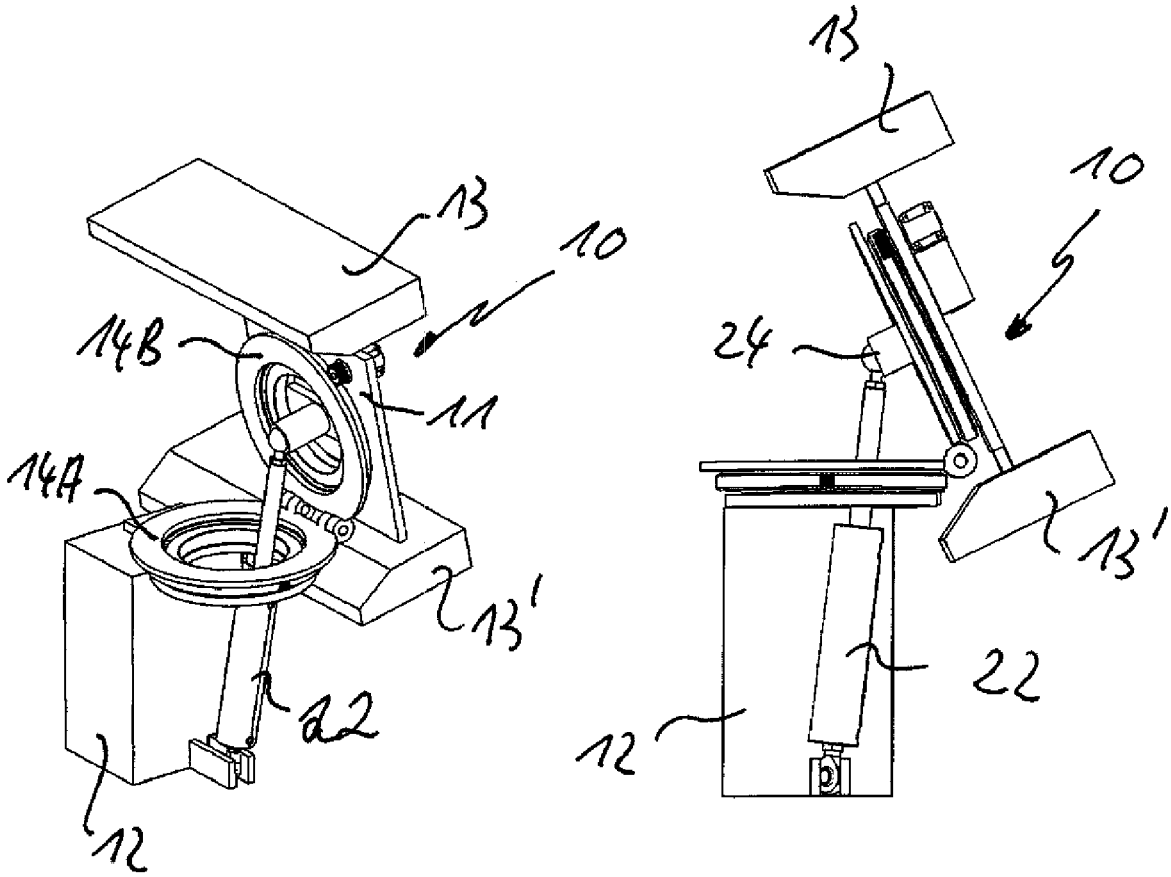
FIG. 5 the operating table of FIGS. 1 to 4 in the position canting to the right.

FIG. 1 shows an operating table in perspective views with a column 12 on which a table top 10 is supported. Only a base plate 11 and a side support 13 of the table top 10 are shown for a better illustration. It is, however, understood that the table top 10 comprises still further construction elements such as covers, mattress elements and the like. In addition, in the representation of FIG. 1, only one side support 13 is shown, although, as FIG. 2 and FIG. 5 show, two parallel side supports 13 and 13' are provided.

The table top 10 is supported on the column 12 so that it can be pivoted, on the one hand, about an axis Y extending transversely to the table top 10 and, on the other hand, about an axis X longitudinally to the table top. For this purpose, the table top 10 is connected to the column 12 via a joint 14 which comprises two pivot parts 14A and 14B, with the joint 14 being rotatable about a vertical axis of rotation Z in the clockwise or anti clockwise direction.

Figure 2:
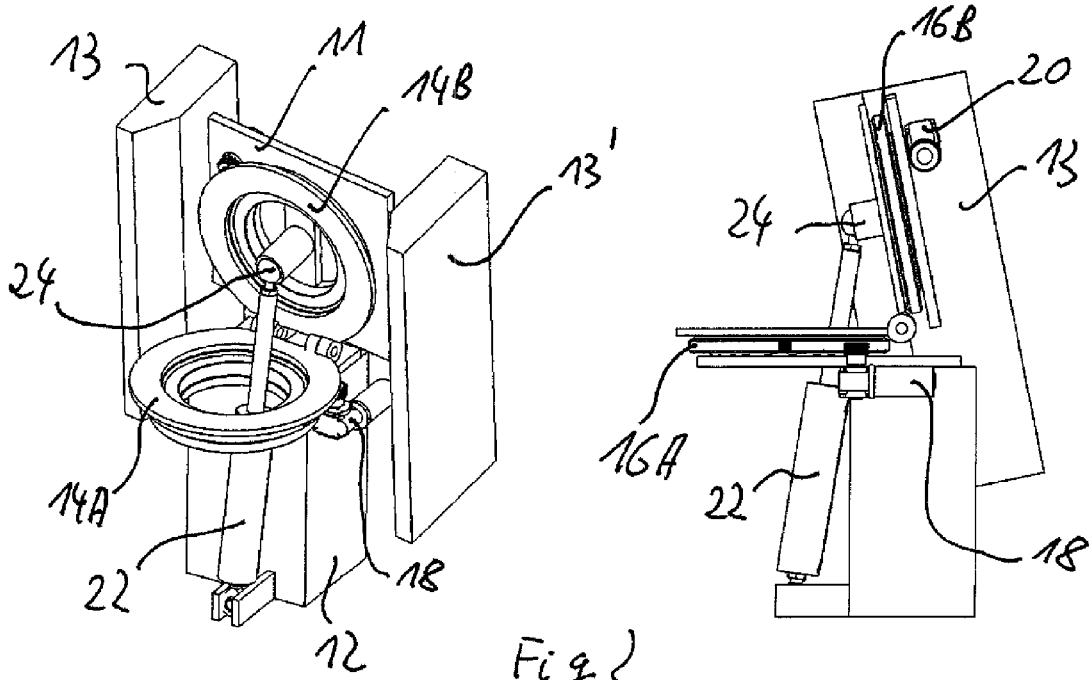
FIG. 2 the operating table of FIG. 1 with reverse trend.

As, for example, FIG. 2 illustrates, the joint 14 in the embodiment shown is made as a pivot plate whose two joint parts 14A and 14B are mutually pivotable about a horizontal axis S (cf. FIG. 1). In this respect, the table top 10 is rotatably fastened to the joint part 14B and the joint part 14A is rotatably fastened to the column 12. The fastening takes place in both cases with the aid of a pivot bearing 16A and 16B, which means that the table top 10 is pivotable with the aid of the pivot bearing 16B relative to the joint part 14B about the central axis of the joint part and that the joint part 14A is pivotable relative to the column 12 about the central axis of the joint part 14A. A first drive motor 18 is provided as the drive for a pivoting of the joint part 14A relative to the column 12 and is fastened in a stationary manner to the column 12 and can rotate the joint part 14A relative to the column 12 about a vertical axis Z. A second drive motor 20 is furthermore provided which is fastened to the table top 10 and which—as also the first drive motor 18—pivots the table top 10 relative to the joint part 14B via a gear drive, and indeed about a pivot axis which extends perpendicular through the center of the annular pivot part 14B.

The joint 14 can be rotated between the column 12 and the table top 10 about the vertical axis of rotation Z using the above-described design in which the pivot axis S of the joint 14 is arranged eccentrically to the central axis of the column 12 and eccentrically to the center of the table top 10, without the position of the table top 10 changing relative to the column 12. For this purpose—starting from the zero position shown in FIG. 1—the two drive motors 18 and 20 are driven in a synchronized manner so that they effect an opposite rotary movement in the region of the pivot bearings 16A and 16B so that the relative position between the column 12 and the table top 10 does not change, but the joint 14 is rotated between the stationary column 12 and the table top 10 not changing its position.

To change the inclination of the table top 10, a single lifting cylinder 22 is provided whose lower end is pivotally connected to the stationary column 12 pivotable about a horizontal axis and whose piston rod can extend through the circular opening formed by the joint part 14A. The upper end of the piston rod of the lifting cylinder 22 is connected via a ball joint 24 to the base plate 11 of the table top 10 so that a pivoting of the table top 10 about the always horizontally orientated pivot axis S of the joint 14 can be achieved by actuating the lifting cylinder 22.

In the embodiment shown, both the table top 10 can be rotated by 360° about the joint part 14B and the pivot part 14A, and thus also the total joint 14, can be rotated 360° about the vertical axis Z by, with in both cases the rotation being able to take place clockwise and counter clockwise.

How the desired pivot positions can be achieved will be explained in the following with reference to the Figures.

Starting from the zero position shown in FIG. 1, in which the base plate 11 of the table top 10 is arranged horizontally and the two joint parts 14A and 14B are not mutually pivoted, the table top 10 can be moved into the reverse trend position in that the joint 14 is rotated in the direction of the foot end of the table top as shown in FIG. 1 until the joint axis S extends parallel to the transverse axis Y. Subsequently, the table top 10 can be pivoted about the pivot axis S by actuating the lifting cylinder 22 and indeed so far until a pivot position of up to 90° is reached.

Figure 3:
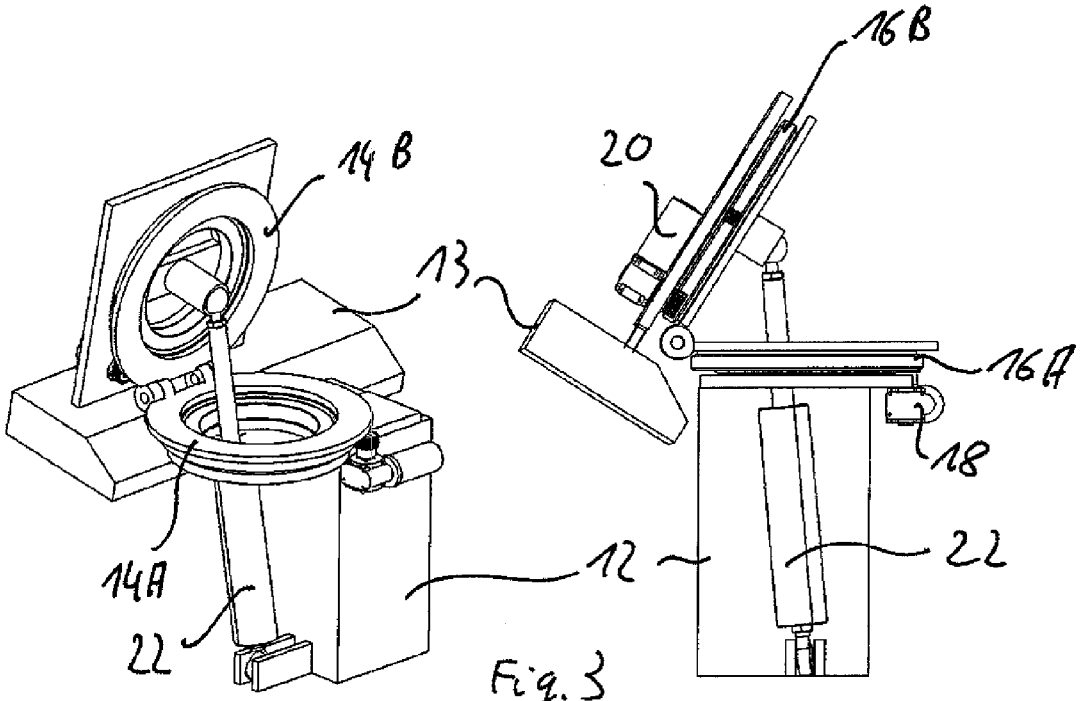
FIG. 3 the operating table of FIGS. 1 and 2 in the position canting to the left.

Again starting from the zero position of FIG. 1, a left canting (tilt) of the table top (10), i.e. a pivoting about the pivot axis X, can be achieved in that the joint 14 is pivoted about the axis of rotation Z by 90° counter clockwise until the pivot axis S extends parallel to the axis X or parallel to the side support 13. Starting from this position shown in FIG. 3, a pivoting of the table top 10 about the longitudinal axis X can again be achieved by actuating the lifting cylinder 22 so that pivot angles of up to 90° are also possible.

Figure 4:
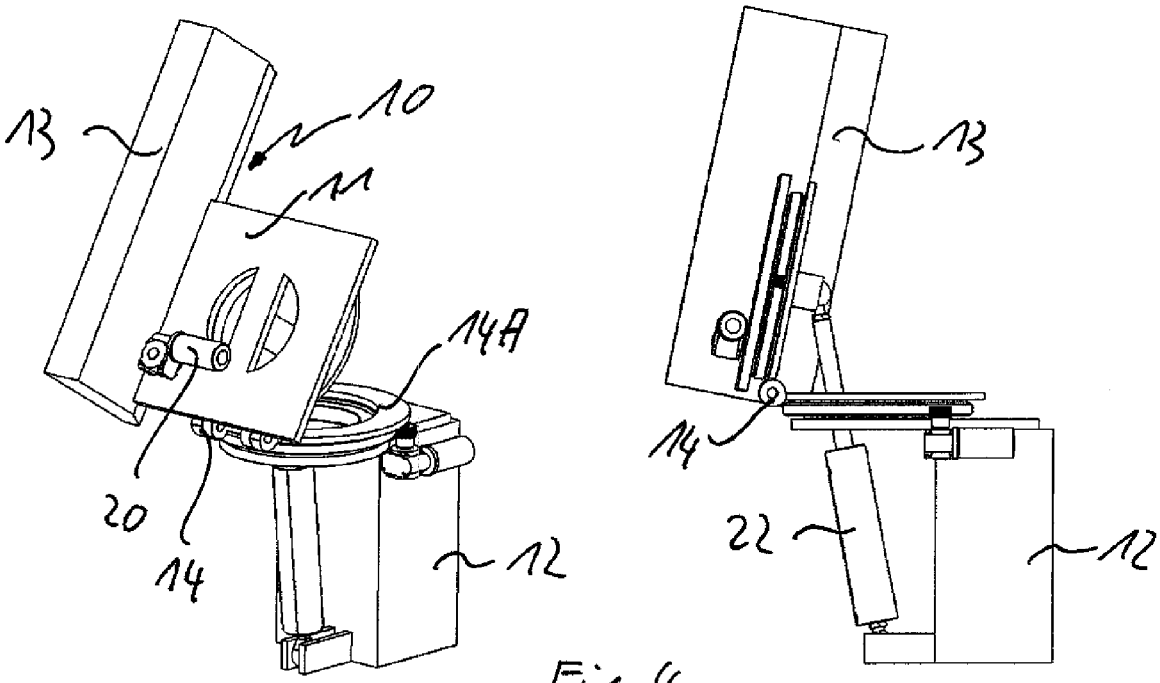
FIG. 4 the operating table of FIGS. 1 to 3 in the trend position.

A pivoting of the table top into the trend position can be achieved in accordance with FIG. 4 in that, starting from the zero position of FIG. 1, the joint 14 is pivoted by 180° about the axis Z so that it faces in the direction of the head end of the table top before the lifting cylinder 22 is actuated.

Finally, FIG. 5 shows a pivoting of the table top as a right canting (tilt), with the joint 14 here having been pivoted in comparison with FIG. 1 by 90° clockwise (in a plan view).

In addition to the positions shown in the above-described Figures, all intermediate positions are naturally also possible so that the table top can be moved into any desired position in that the drive motors 18 or 20 and the lifting cylinder 22 are actuated accordingly. It is understood in this respect that the lifting cylinder can be actuated electrically, hydraulically or also pneumatically and that a lifting cylinder in the sense of the present invention is understood as any linear positioning device with which the table top can be pivoted about the joint 14. Alternatively, it is possible to provide, instead of the lifting cylinder, an electric or hydraulic direct drive, for example an electric motor, in the region of the joint 14 which pivots the two joint parts toward one another.

REFERENCE NUMERAL LIST

10 table top
11 base plate
12 column
13, 13' side supports
14 joint
14A, 14B joint parts
16A, 16B pivot bearings
18, 20 drive motor
22 lifting cylinder
24 ball joint
S pivot axis of the joint
x longitudinal axis
Y transverse axis
Z vertical axis of rotation

The invention claimed is:

1. An operating table having a column (12) on which a tabletop (10) is supported so that it is pivotable about an axis (Y) extending transversely to the tabletop (10) and about an axis (X) extending longitudinally to the table top, characterized in that the table top (10) is connected to the column (12) via a joint (14) comprising two joint parts (14A, 14B), with the joint (14) being rotatable about a vertical axis of rotation (Z) and one joint part (14B) is rotatably fastened to the table top (10) and is rotatable about an axis of rotation which is oriented perpendicular to the tabletop (10) and one joint part (14A) is rotatably fastened to the column (12).

2. An operating table in accordance with claim 1, characterized in that the pivot axis (S) of the joint (14) has a horizontal orientation.

3. An operating table in accordance with claim 1, characterized in that a single joint (14) is provided between the table top (10) and the column (12), with in particular the relative position between the table top (10) and the joint (14) and/or the relative position between the column (12) and the joint (14) being changeable.

4. An operating table in accordance with claim 1, characterized in that the pivot axis (S) of the joint (14) is arranged eccentrically to the central axis of the column (12) and/or eccentrically to the center of the table top (10).

5. An operating table in accordance with claim 1, characterized in that the joint (14) is rotatable about the vertical axis of rotation (Z) between the column (12) and the table top (10) without the position of the table top (10) changing relative to the column (12).

6. An operating table in accordance with claim 1, characterized in that a single lifting cylinder (22) is provided to change the inclination of the table top (10).

7. An operating table in accordance with claim 1, characterized in that a lifting cylinder (22) is connected to the table top (10) via a ball joint (24) for the inclination adjustment of the table top (10).

8. An operating table in accordance with claim 1, characterized in that two rotary drives (18, 20) are provided for a pivoting of the table top (10).

9. An operating table in accordance with claim 8, characterized in that a controller is provided with which the two drives (18, 20) can be driven in a synchronized manner.

10. An operating table in accordance with claim 1, characterized in that a total of precisely one lifting cylinder (22) and two rotary drives (16A, 16B, 18, 20) are provided for a pivoting of the table top (10).

11. An operating table in accordance with claim 1, characterized in that the joint (14) is a pivot plate whose two joint parts (14A, 14B) are mutually pivotable about a horizontal axis (S).

12. An operating table in accordance with claim 1, characterized in that the two joint parts (14A, 14B) each have an opening, with a lifting cylinder being led through an opening of a joint part (14A).

13. An operating table in accordance with claim 1, characterized in that the two joint parts (14A, 14B) are each made as a ring.

14. An operating table in accordance with claim 1, characterized in that the joint (14) is rotatable by 360° about the vertical axis of rotation (Z).

15. An operating table having a column (12) on which a tabletop (10) is supported so that it is pivotable about an axis (Y) extending transversely to the tabletop (10) and about an axis (X) extending longitudinally to the table top, characterized in that the table top (10) is connected to the column (12) via a joint (14) comprising two joint parts (14A, 14B),each joint part having an opening, with a lifting cylinder being led through an opening of a joint part (14A), with the joint (14) being rotatable about a vertical axis of rotation (Z) and one joint part (14B) is connected to the table top (10) and is rotatable relative to the table top (10) about an axis of rotation which is oriented perpendicular to the table top (10).

* * * * *